US005860742A

United States Patent [19]

Faircloth, Jr.

[11] Patent Number: 5,860,742

[45] Date of Patent: Jan. 19, 1999

[54] FLEXIBLE BAG DISPENSER

[76] Inventor: J. Wade Faircloth, Jr., 119 Hatcher Dr., Newport, N.C. 28570

[21] Appl. No.: 920,292

[22] Filed: Aug. 28, 1997

[51] Int. Cl.[6] ..... B65D 33/16

[52] U.S. Cl. ..... 383/80; 220/212; 220/254; 220/735

[58] Field of Search ..... 383/33, 80, 96; 220/212, 254, 735, 495.03, 495.05, 495.08, 495.11

[56] References Cited

U.S. PATENT DOCUMENTS

| | | | |
|---|---|---|---|
| 1,221,372 | 4/1917 | Peden | 383/96 X |
| 1,439,329 | 12/1922 | Randolph | 383/80 |
| 3,334,778 | 8/1967 | Saunders | 220/735 X |
| 3,487,974 | 1/1970 | Schovee . | |
| 3,533,807 | 10/1970 | Wakefield . | |
| 3,550,805 | 12/1970 | Robbins, III et al. | 220/495.11 X |
| 3,656,668 | 4/1972 | Liebertz . | |
| 3,893,649 | 7/1975 | Cornell et al. . | |
| 4,411,300 | 10/1983 | Rico . | |
| 4,444,355 | 4/1984 | Cary . | |
| 4,630,752 | 12/1986 | DeMars . | |
| 4,732,299 | 3/1988 | Hoyt . | |
| 4,917,263 | 4/1990 | Korb . | |
| 5,150,810 | 9/1992 | Loebbert . | |
| 5,236,022 | 8/1993 | Husted . | |
| 5,257,865 | 11/1993 | Tani . | |
| 5,407,089 | 4/1995 | Bird et al. . | |
| 5,415,309 | 5/1995 | Wang . | |
| 5,443,174 | 8/1995 | Bauer | 220/212 |
| 5,641,947 | 6/1997 | Riddle, Jr. . | |

FOREIGN PATENT DOCUMENTS

| | | | |
|---|---|---|---|
| 3828330 | 2/1990 | Germany | 220/212 |
| 4036945 | 5/1992 | Germany | 220/212 |
| 1604678 | 11/1990 | U.S.S.R. | 383/80 |
| 1671536 | 8/1991 | U.S.S.R. | 383/33 |

*Primary Examiner*—Jes F. Pascua
*Attorney, Agent, or Firm*—Rhodes, Coats & Bennett, L.L.P.

[57] ABSTRACT

A closure is attached across the open mouth of a flexible bag for use in closing the bag and dispensing solid, particulate material therefrom. The closure is formed of a continuous ring having a circumference approximating the circumference of the bag mouth, and include a first wall engaging one side of the bag adjacent the bag mouth, and a cover extending across the bag mouth, the cover having a top surface with at least one access opening, a removable cap for the opening, and a continuous rim extending downwardly from the top surface, the rim having a second wall engaging the opposite side of the bag adjacent the bag mouth, the first and second walls being adapted to clamp the upper edge of the bag.

15 Claims, 3 Drawing Sheets

FLEXIBLE BAG DISPENSER

BACKGROUND OF THE INVENTION (1) Field of the Invention

The present invention relates generally to a device for dispensing particulate material from a flexible bag, and in particular to a closure that can be fitted across the mouth of a flexible bag to facilitate storage and removal of particulate material from the bag. The invention also relates to the assembled closure and bag, and to a unique dispenser cap that can be used as part of the closure.

(2) Description of the Prior Art

Numerous solid, particulate products are packaged in flexible bags for sale to consumers. Such products include dry dog food, cat litter, birdseed, etc. This type of packaging, as opposed to solid containers, is favored due to its low cost of manufacture and its space requirements. However, flexible packaging is not as convenient to the ultimate consumer when less than the entire package contents is to be used at one time.

When a flexible bag containing multiple portions is to be used, the consumer first opens the top of the bag by cutting open the top or by pulling a string or tab holding the edges of the bag together, to create an open mouth at the top of the bag.

After the consumer removes a portion of the bag contents, e.g., by pouring the contents from the bag, or by using a scoop, the bag must then be reclosed. Normally, this closure is effected by rolling or twisting the top of the bag, or by tying the top of the bag with a string or other tie. Neither of these methods is entirely effective. Tops that are simply rolled or twisted tend to come undone, allowing moisture or rodents, insects and the like, access to the bag contents. If the bag is turned over, the contents are also likely to spill. A string or tie is often lost, and must be undone, often with difficulty, when access to the bag is needed again.

An improved method and apparatus that would provide the economical advantages of multi-use flexible packaging of solid, particulate materials, without the heretofore inherent disadvantage associated with closing of the bag after removal of a portion of the bag contents, would be of considerable economic value and convenience.

SUMMARY OF THE INVENTION

The present invention is directed to a method and device for closing a flexible between dispensing of its contents. The invention relates especially to a dispensing closure to be fitted across the mouth of a flexible bag containing multiple portions of solid, particulate material, to the method of using the closure with the flexible bag, and to the combination of the flexible bag and closure. Also, the invention relates to a dispensing cap that can be used as a part of the closure.

As used in the following description of the invention, the term "flexible bag" is intended to mean a container having a continuous flexible side wall; a closed bottom wall across the bottom of the side wall; and a mouth, whether closed or open, defined by the upper, continuous edge of the side wall. The bag can be formed of various materials, including single or multi-layer paper, or plastic. When purchased, the mouth of the bag will normally be closed with a string or other temporary closure or by scaling together the opposed sides of the sidewall.

As used herein, the term "solid, particulate materials" is intended to broadly encompass a wide variety of products comprised of discrete particles, that are normally packaged in flexible bags for shipping, and then dispensed from the bag by the end user. The materials may be naturally occurring, such as birdseed, or manufactured materials, such as granular pet food. While the invention is primarily directed to dispensing of human or animal edible products purchased in flexible packaging from retail outlets, such as grocery stores, it will be understood that the invention is also applicable to dispensing of other bulk staple, as well as non-edible particulate materials, and in industrial environments.

Generally, the closure of the present invention is comprised of a ring having a circumference corresponding to the circumference of the bag mouth to which the closure is to be attached, and a cover adapted to be attached over the bag mouth. The cover will generally include a planar, impermeable surface having an outer periphery corresponding to the circumference of the ring and adapted to be secured to the rim, and one or more capped dispensing opening in the closure surface.

Alter fully opening the mouth of the flexible bag, the user will position the ring around the edge of the bag mouth, either on the outside or inside wall of the bag, and then fold the upper edge of the bag over the rim. The cover will then be positioned across the bag mouth, and clamped in place. Material within the bag is then dispensed through by through an uncapped dispensing opening in the closure surface. After dispensing, either by scooping or pouring the contents, the dispensing opening is recovered, preventing access to the bag's contents by moisture or vermin, and avoiding spillage if the bag is inadvertently turned over.

The ring forming a part of the closure is in the shape of a continuous rim having inner and outer sidewalls, and upper and lower edges. The circumference of the ring corresponds approximately to the circumference of the bag mouth. The ring may be placed on the inside or outside of the bag. Therefore, when the ring is to be used on the inside the bag, the outer circumference of the ring may be substantially equal to the inner circumference of the bag. On the other hand, when the ring in to be used on the outside the bag, the inner circumference of the ring may be substantially equal to the outer circumference of the bag. It should be understood, however, that the ring circumference does not need to be exactly the same as the bag circumference, due to stretching of the bag mouth, or portions thereof overlapping.

The shape of the ring is not critical to the invention. However, for ease of attachment to the bag, it has been found that the ring is preferably elliptical in shape, e.g., oval or circular. It should be understood, however, that other shapes, such as rectangular, are contemplated by the invention. The thickness and height dimensions of the ring are not critical, so long as a ring has some degree of dimensional stability. The ring may be formed of various materials, although molded plastic will normally be used due to its cost and ease of shaping.

The cover is comprised of an upper surface or top plate with an outer periphery or edge, and a continuous rim integral with, and extending downwardly from, the plate's outer edge. The continuous rim may be a single rim, or a rim comprised of parallel, spaced inner and outer rim segments. For most purposes, the upper surface will be planar, since this is the most economical shape. However, the plate works equally well if of a different shape, e.g., convex or concave.

The plate contains at least one opening for removal of the contents of the bag. A removable cap is provided for capping the opening when material is not being dispensed. As will be noted later, the cap of one of the openings can be scoop-shaped, so that the cap can also be used to scoop material from the bag through the opening. The plate may contain multiple openings. For example, the plate may include a small opening for pouring of the bag contents, and a larger opening from which the contents can be scooped.

The periphery of the plate will ordinarily correspond to the periphery of the ring. The rim extending down from the plate has opposed inner and outer walls, and is designed to clamp the bag against the ring. That is, when the bag is folded over the ring, either from the inside to the outside of the ring, or from the ring's outside to the inside, the rim is designed to fit over the upper part of the bag that is adjacent the ring, and frictionally hold the bag between the rim and ring. When the rim is comprised of inner and outer parallel, spaced rim segments, the inner rim will clamp the bag against the inner wall of the rim, while the outer rim segment will clamp the bag against the outer wall of the rim.

Therefore, the outer circumference of the rim will approximate the inner circumference of the ring, or the inner circumference of the rim will approximate the inner circumference of the ring, depending on whether the rim is to be fitted inside or outside the ring. The term "approximate" is intended to indicate that the relative dimensions allow space for the wall of the bag to be clamped between the rim and ring.

Frictional engagement of the rim and ring on opposite sides of the bag wall may be sufficient to secure the bag between the ring and rim, and hold the cover in place. However, frictional engagement can be enhanced by using male and female mating members on facing rim and ring walls. That is, one of the facing walls may include a peripheral ridge or flange, while the one facing wall includes a corresponding peripheral recess. With this configuration, the walls snap together, clamping the bag wall tightly between the rim and ring walls.

As noted above, one of the removable caps used to cover the access openings in the plate can be scoop-shaped. That is, the cap can have a bottom wall with integral side and rear walls, and a handle extending from the rear of the rear wall. The front of the scoop is left open for dispensing the scoop contents. The bottom wall may upwardly curved. In order to also serve as a removable cap, the scoop includes a closure attached to the lower or under side of the bottom wall.

Generally, the shape of the scoop closure will correspond to the shape of the opening to be closed, although the exact configuration of the scoop closure will vary dependent upon the configuration of the opening to be closed. The scoop closure will include a peripheral surface corresponding to, and mating with, the periphery of the plate opening. For example, the opening may include an upstanding continuous wall around its periphery, while the scoop closure also includes a continuous wall that fits around the opening wall.

Preferably, the opening covered by the scoop-shaped cap will be elongated. That is, the opening will have a length greater than its width. For example, the opening can be elliptical or rectangular. Also, the length of the elongated opening will be greater than the width of the scoop-shaped cap, and the width of the opening will be greater that the height of the scoop-shaped cap. With this configuration, the scoop-shaped cap, after being removed from the opening, can be inserted through the opening into the interior of the bag to scoop out a part of the bag contents.

The bag closure of the invention may include additional elements to enhance its use. For example, the bag closure may include a handle attached to the plate to assist in holding the closure when the closure and bag are carried, or material is dispensed. Additionally, the closure may include a hanging loop, so that the closure can be hung on the wall when being stored.

Accordingly, one aspect of the present invention is to provide a device for use in closing the mouth of a flexible bag containing solid particulate material, and for dispensing material therefrom, comprising a continuous ring having a circumference approximating the circumference of the bag mouth, the ring including a first bag engaging wall; and a cover having a top surface with at least one access opening for removal of material from the bag, a removable cap for the opening, and a continuous rim extending downwardly from the top surface, the rim having a second bag engaging wall, the first and second bag engaging walls being adapted to clamp the mouth of the bag, whereby the top plate extends across the bag mouth.

Another aspect of the present invention is to provide a container for holding and dispensing solid, particulate material comprising a flexible bag having a continuous side wall with opposed inner and outer surfaces, and a closed bottom, the upper edge of the side wall forming an open mouth; a continuous ring having a circumference approximating the circumference of the bag mouth, the ring including a first wall against one of the wall surfaces at adjacent the upper edge; and a cover having a top surface with at least one access opening for removal of material from the bag, a removable cap for the opening, and a continuous rim extending downwardly from the top surface, the rim having a second wall against the other bag surface, clamping the upper edge of the bag between the first and second walls, with the plate extending across the bag mouth.

Still another aspect of the present invention is to provide a method of closing the mouth of a flexible bag having a continuous side wall with inner and outer surfaces, and an upper edge forming an open mouth, and a closed bottom, comprising positioning a continuous ring having a circumference approximating the circumference of the bag mouth adjacent one wall surface at the upper edge of the bag; and positioning a cover having a top surface with at least one access opening for removal of material from the bag across the bag mouth, the cover including a removable cap for the opening, and a continuous rim extending downwardly from the top surface, the rim being positioned adjacent the other wall surface, whereby the first and second walls clamp the upper edge of the bag.

Still another aspect of the invention is to provide a particulate material container having a cover with an elongated access opening, and a removable scoop-shaped cap covering the opening, the cap having a given length and a given height, the opening having a length greater than the cap length and a width greater than the cap height, whereby the scoop-shaped cap can be inserted through the opening to remove particulate material from the container.

These and other aspects of the present invention will become apparent to those skilled in the art after a reading of the following description of the preferred embodiment.

DETAILED DESCRIPTION OF THE INVENTION

Figure 1:
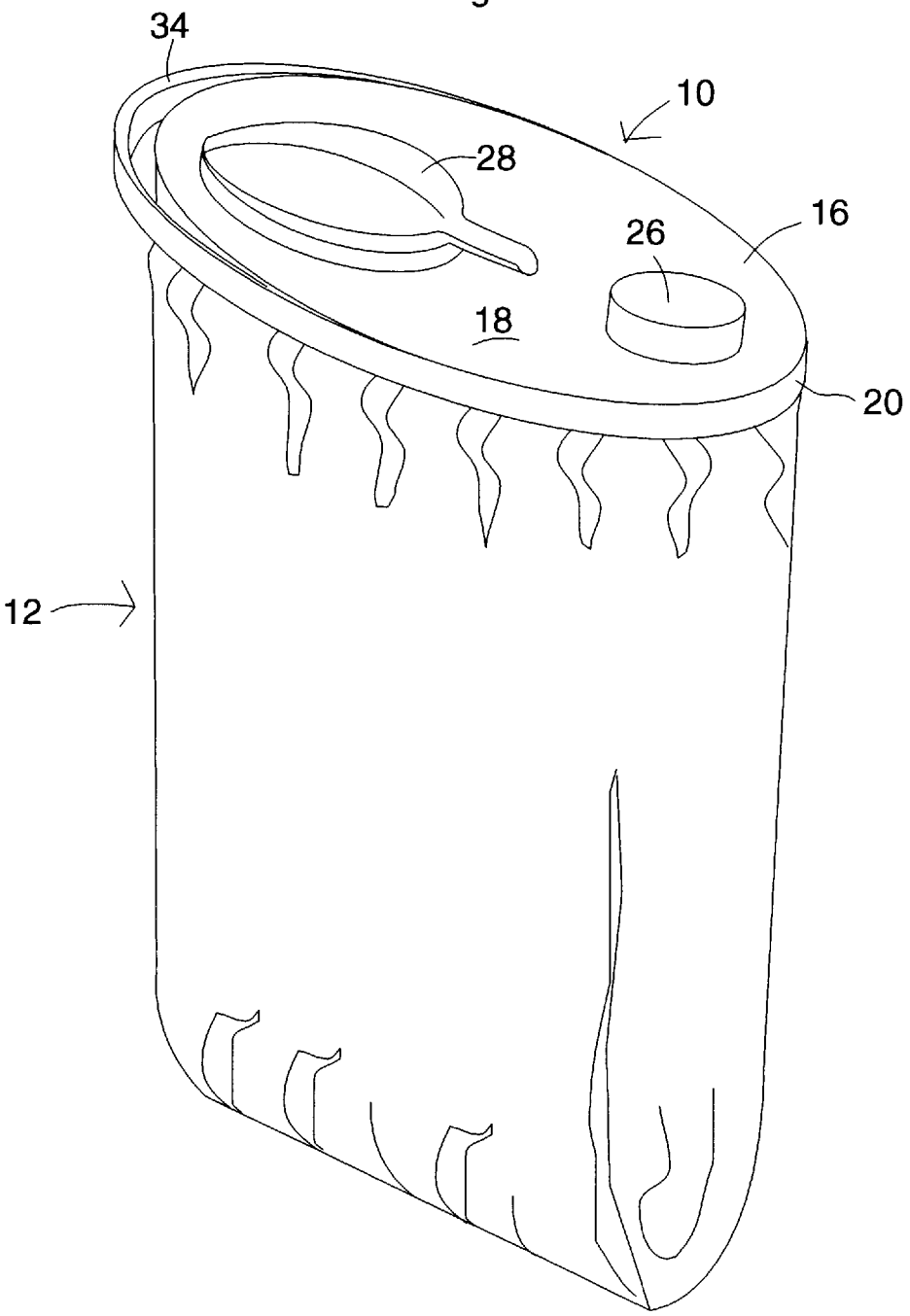
FIG. 1 is a perspective view of the assembled flexible bag and closure.
Figure 2:
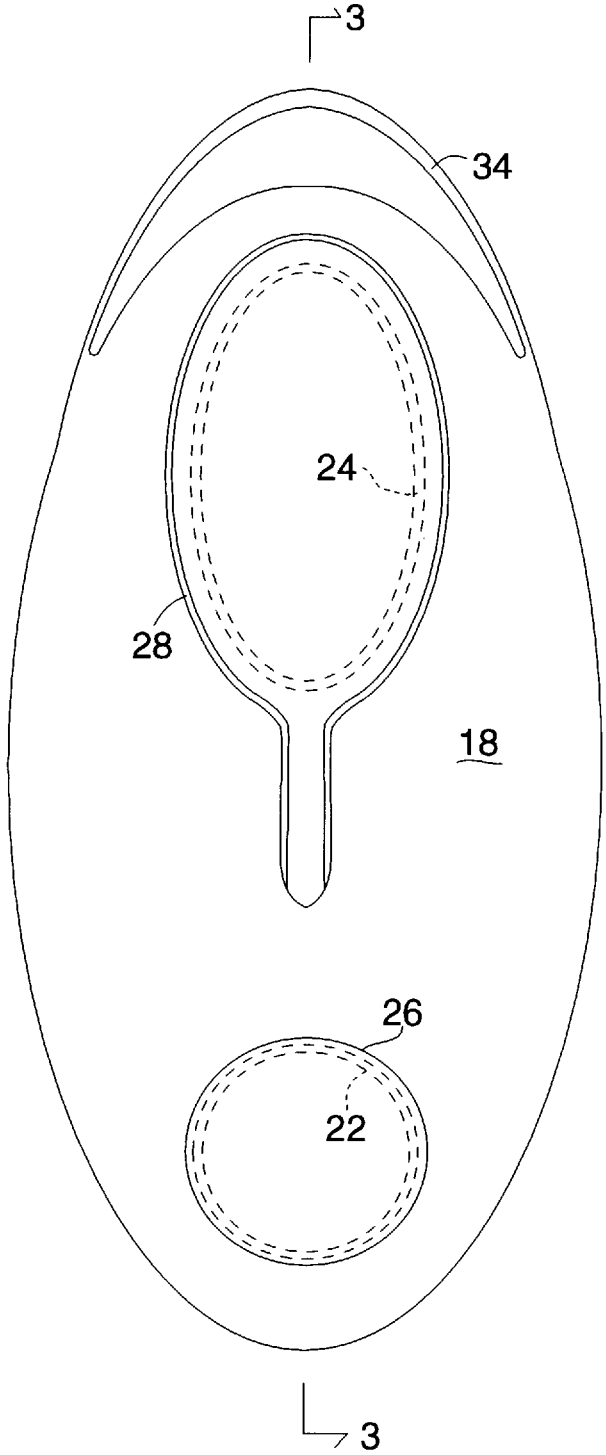
FIG. 2 is a top view of the closure.
Figure 3:
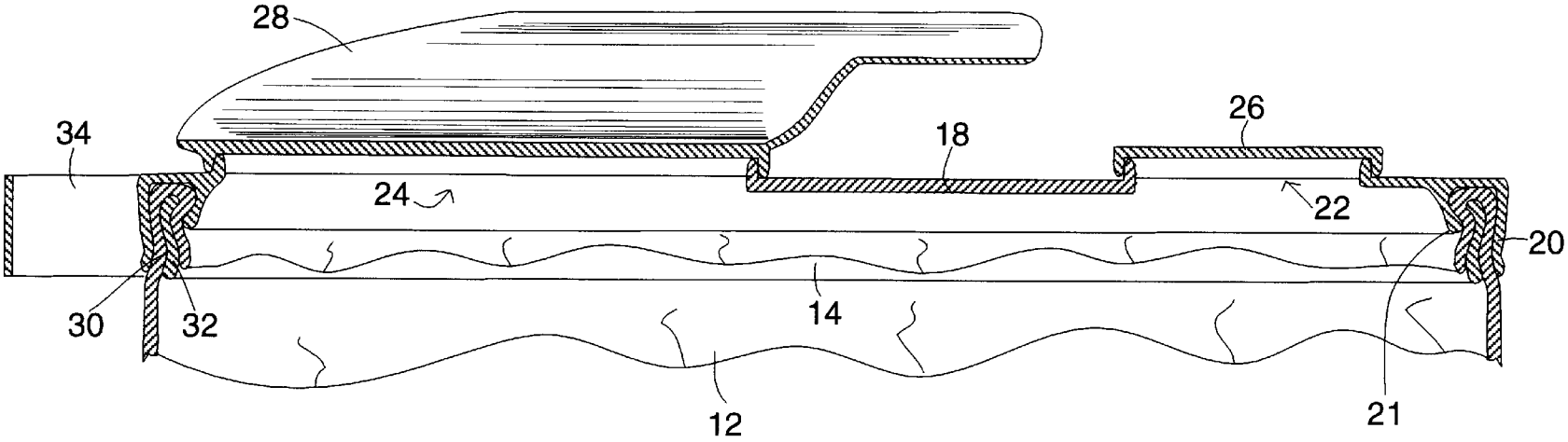
FIG. 3 is a sectional side view of the closure of FIG. 2 along lines 3—3, attached to a flexible bag, partly shown.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated in the drawings, a closure, generally 10, is shown fitted over the mouth of a flexible bag, generally 12. Closure 10 is comprised of a ring 14 having a circumference corresponding to the circumference of the mouth of bag 12, and a cover 16. Cover 16 includes a planar surface or top plate 18 with an outer periphery or edge, and a continuous rims 20 and 21 integral with, and extending downwardly from, the periphery of plate 18. Plate 18, in the preferred embodiment shown, contains two openings 22 and 24 for dispensing of the bag contents. A first removable cap 26 is used to cap opening 22, while a scoop-shaped cap 28 is used to cap opening 24.

Ring 14 has a continuous circumference corresponding approximately to the circumference of the open mouth of bag 12, and has inner and outer sidewalls, and upper and lower edges. As illustrated, ring 14 is positioned inside the mouth of bag 12, with the upper edge of bag 12 being folded over the upper edged of ring 14 into the interior of bag 12. Ring 14 is elliptically shaped.

The periphery of top plate 18 corresponds to the periphery of ring 14, and rims 20 and 21 extend downwardly from periphery of plate 18 and clamps bag 12 between ring 14 and adjacent walls of rims 20 and 21. Frictional engagement is increased by male and female mating members 30 and 32 on rim 20 and ring 14, respectively.

Access openings 24 is an elliptical or oval shaped opening, with a length greater than its width, while scoop-shaped cap 28 has a length less that the length of opening 24, and a height less than the width of opening 24. Therefore, cap 28, after being removed from opening 24, can be inserted through opening 24 to remove the contents of bag 12. Closure 10 also includes a handle 34 projecting outwardly from one end of closure 10 that can be grasped when pouring the contents of bag 12 from opening 22.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A device for use in closing the mouth of a flexible bag containing solid particulate material, and for dispensing material therefrom, comprising:

a) a continuous ring having a circumference approximating the circumference of said bag mouth, said ring including a first bag engaging wall; and b) a cover having a top surface with at least one elongated access opening for removal of material from said bag, and a continuous rim extending downwardly from said top surface, said rim having a second bag engaging wall, said first and second bag engaging walls being adapted to clamp the mouth of said bag, whereby said top plate extends across said bag mouth; and c) a removable scoop-shaped cap having a bottom wall with integral side and rear walls and a handle extending from the rear wall, and a closure on the lower side of said bottom wall with a shape corresponding to the shape of said elongated opening, said cap having a given length and a given height, said elongated opening having a length greater than said cap width and a width greater than said cap height, whereby said scoop-shaped cap can be inserted through said opening to remove particulate material from said container.

2. The device of claim 1, wherein said ring is elliptical.

3. The device of claim 1, wherein said cover has two access openings.

4. The device of claim 1, wherein said cover includes a handle.

5. The device of claim 1, wherein said first and second walls include male and female mating members.

6. The device of claim 1, wherein said top plate is planar.

7. A container for holding and dispensing solid, particulate material comprising:

a) a flexible bag having a continuous side wall with opposed inner and outer surfaces, and a closed bottom, the upper edge of said side wall forming an open mouth;

b) a continuous ring having a circumference approximating the circumference of said bag mouth, said ring including a first wall against one of said wall surfaces at adjacent said upper edge; and c) a cover having a top surface with at least one elongated access opening for removal of material from said bag, and a continuous rim extending downwardly from said top surface, said rim having a second wall against the other bag surface, clamping the upper edge of said bag between said first and second walls, with said plate extending across said bag mouth; and d) a removable scoop-shaped cap having a bottom wall with integral side and rear walls and a handle extending from the rear wall, and a closure on the lower side of said bottom wall with a shape corresponding to the shape of said elongated opening, said cap having a given length and a given height, said elongated opening having a length greater than said cap width and a width greater than said cap height, whereby said scoop-shaped cap can be inserted through said opening to remove particulate material from said container.

8. The device of claim 7, wherein said bag upper edge is folded over said ring.

9. The device of claim 7, wherein said ring first wall engages the inner surface of said wall.

10. The device of claim 7, wherein said ring engages the outer surface of said wall.

11. A particulate material container comprising:

a) a bag having a continuous flexible side wall with an upper edge, a closed bottom wall, and an open mouth formed by the upper edge of the side wall;

b) a cover having a planar top surface with an elongated opening and a second opening, and a continuous rim extending downwardly from said top surface, said rim having a second bag engaging wall, said first and second bag engaging walls being adapted to clamp the mouth of said bag, whereby said top plate extends across said bag mouth; and c) a removable scoop-shaped cap having a bottom wall with integral side and rear walls and a handle extending from the rear wall, and a closure on the lower side of said bottom wall having a shape corresponding to the shape of said elongated opening, said cap having a given length and a given height, said elongated opening having a length greater than said cap width and a width greater than said cap height, whereby said scoop-shaped cap can be inserted through said elongated opening to remove particulate material from said container; and d) a removable cap for closing said second opening.

12. The container of claim 11, wherein said first opening is elliptical.

13. The container of claim 11, wherein said first opening includes an upstanding continuous wall about its periphery and said scoop-shaped cap closure includes a continuous wall that fits around the opening wall.

14. The container of claim 11, wherein said cover includes a handle.

15. The container of claim 11, wherein the bottom wall of said scoop-shaped cap is upwardly curved.

* * * * *